US010450115B2

(12) United States Patent
Douvdevani et al.

(10) Patent No.: US 10,450,115 B2
(45) Date of Patent: Oct. 22, 2019

(54) PLASTIC CAP APPLICATOR

(71) Applicant: COLORIGHT LTD., Rehovot (IL)

(72) Inventors: Shmuel Douvdevani, Ness Ziona (IL); Zah Naftaly, Petah-Tikva (IL); Efraim Miklatzky, Newe-Ilan (IL); Daniel Mandelik, Rehovot (IL)

(73) Assignee: COLORIGHT LTD., Rehovot (IL)

( * ) Notice: Subject to any disclaimer, the term of this patent is extended or adjusted under 35 U.S.C. 154(b) by 0 days.

(21) Appl. No.: 15/872,605

(22) Filed: Jan. 16, 2018

(65) Prior Publication Data

US 2018/0201417 A1 Jul. 19, 2018

Related U.S. Application Data

(60) Provisional application No. 62/447,230, filed on Jan. 17, 2017.

(51) Int. Cl.
*B65D 47/24* (2006.01)
*B65D 41/04* (2006.01)
*B65D 83/46* (2006.01)

(52) U.S. Cl.
CPC ..... *B65D 47/248* (2013.01); *B65D 41/0407* (2013.01); *B65D 83/46* (2013.01)

(58) Field of Classification Search
CPC ... B65D 41/0407; B65D 47/248; B65D 83/46
USPC ..... 222/386, 399, 400.7, 402.1, 222/402.21–402.23
See application file for complete search history.

(56) References Cited

U.S. PATENT DOCUMENTS

| | | | | |
|---|---|---|---|---|
| 2,829,806 | A * | 4/1958 | Tedaldi | B65D 83/46 222/402.22 |
| 3,357,604 | A * | 12/1967 | Barker | B65D 83/46 222/402.23 |
| 4,804,116 | A | 2/1989 | Ball | |
| 4,958,755 | A * | 9/1990 | Gerstung | B65D 83/46 222/402.23 |
| 8,905,273 | B2 * | 12/2014 | de Schrijver | B65D 83/201 222/402.1 |
| 9,446,894 | B2 * | 9/2016 | Martz | F16K 31/58 |
| 2009/0078902 | A1 * | 3/2009 | Flynn | B65D 83/46 251/149.8 |
| 2014/0048568 | A1 * | 2/2014 | Demey | B65D 83/202 222/402.22 |

(Continued)

OTHER PUBLICATIONS

International Search Report and Written Opinion dated Apr. 23, 2018 in PCT/IB2018/000069, citing documents AA and AB therein, 14 pages.

*Primary Examiner* — Vishal Pancholi
(74) *Attorney, Agent, or Firm* — Oblon, McClelland, Maier & Neustadt, L.L.P.

(57) ABSTRACT

A support device configured to be coupled to a dispensing container that includes a tilt valve stem for dispensing a cosmetic cream. The support device includes a cap made of a plastic material that includes an opening for receiving the tilt valve stem and an outer surface configured to attach to the dispensing container, wherein the outer surface attaches to the dispensing container via threads; and a valve configured to be disposed between an inner surface of the cap and the tilt valve stem, the valve being configured to reinforce a return force experience by the stem.

6 Claims, 5 Drawing Sheets

(56) References Cited

U.S. PATENT DOCUMENTS

| | | | | |
|---|---|---|---|---|
| 2015/0014366 | A1* | 1/2015 | Demarest | B65D 83/207 222/394 |
| 2015/0108387 | A1 | 4/2015 | Smith | |
| 2015/0375922 | A1* | 12/2015 | Smith | B65D 83/48 251/333 |
| 2016/0376087 | A1* | 12/2016 | Smith | F16K 1/32 222/402.1 |

* cited by examiner

PLASTIC CAP APPLICATOR

CROSS-REFERENCE TO RELATED APPLICATIONS

This application claims the benefit of U.S. provisional application Ser. No. 62/447,230, filed on Jan. 17, 2017. The entire contents of which are incorporated herein by reference.

BACKGROUND

1. Field of the Invention

The present invention relates to a tilt valve used in a container for dispensing a cosmetic formulation.

2. Description of the Related Art

Conventional tilt valves consist of a hollow tubular stem attached to an elastic sealing grommet. The grommet is attached to a metal cup that is snapped onto the container. When tilting the valve, material is pushed by the positive pressure in the container through orifices in the stem. A combination of the elasticity of the grommet and the pressure of inside the container seals the valve back into the upright position when the user stops tilting the valve.

FIGS. 1A and 1B show a conventional tilt valve as disclosed in EP 2481688 (incorporated herein by reference). The structure in FIG. 1A includes a valve cup (3) for tightly closing the container, comprising a through opening, and a first annular fold (3C) of diameter forming a groove in a first, inner surface and a rib in a second, outer surface. The valve structure of FIG. 1A further includes a resilient grommet (2) extending on both side of the cup trough the cup opening, and (c) A valve stem (1) comprising a hollow tubular portion (1A) defining a central bore (1C), said valve stem snugly fitting in the grommet central bore, and extending on both sides of the grommet (2), with a first end opening to ambient and a second, opposite end being closed by a circular end base (1B) of diameter greater than the diameter of the bore of the grommet (2), wherein the upper surface of the base (1B) is suitable for sealing against the lower surface of the grommet flange (2B); the upper surface of the flange portion (2B) of the grommet mating the geometry of the first, inner surface of the cup (3) including the portion (2C) of the grommet mating the groove formed by the fold (3C). The valve is actuated by tilting it, as illustrated in FIGS. 1A and 1B.

Regular aerosol tilt-valves present two main inadequacies when applied to the requirements of cosmetic cream dispensing system:

- The creams contain peroxides that cannot come into contact with metal.
- The creams are shipped under low or even zero bars pressure above atmosphere, significantly lower than most use cases, leading to leakage of material.

In particular, the system will have creams shipped either in piston based cylindrical plastic containers, or in plastic bags that will be inserted into multi use plastic containers. A tilt valve may be provided in the dispensing system in both cases; attached directly to the cylindrical piston container, or to the bag. The material is shipped at low or zero pressure and the dispenser is generating the necessary compression only when in use. This results in valves that do not return fully to the upright position when tilted, leading to material leakage.

SUMMARY

In an embodiment, a support device is configured to be coupled to a dispensing container that includes a tilt valve stem for dispensing a cosmetic cream, the support device comprising: a cap made of a plastic material that includes an opening for receiving the tilt valve stem and an outer surface configured to attach to the dispensing container, wherein the outer surface attaches to the dispensing container via threads; and a valve configured to be disposed between an inner surface of the cap and the tilt valve stem, the valve being configured to reinforce a return force experience by the stem.

In an embodiment, the valve is made of a material is made of rubber.

In an embodiment, the cosmetic cream is provided within the dispensing container at zero pressure.

In an embodiment, the cosmetic cream includes a peroxide.

In an embodiment, the valve is configured to be disposed in a recess of the inner surface of the cap.

DETAILED DESCRIPTION

Figure 1B:
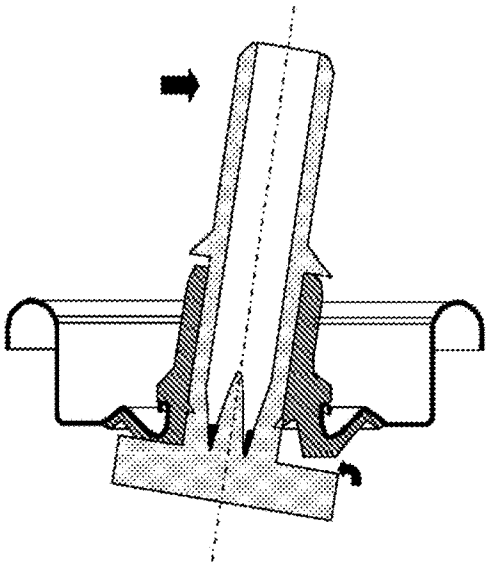
Fig. 1B Background Art
FIGS. 1A and 1B show a conventional tilt valve system.
Figure 1A:
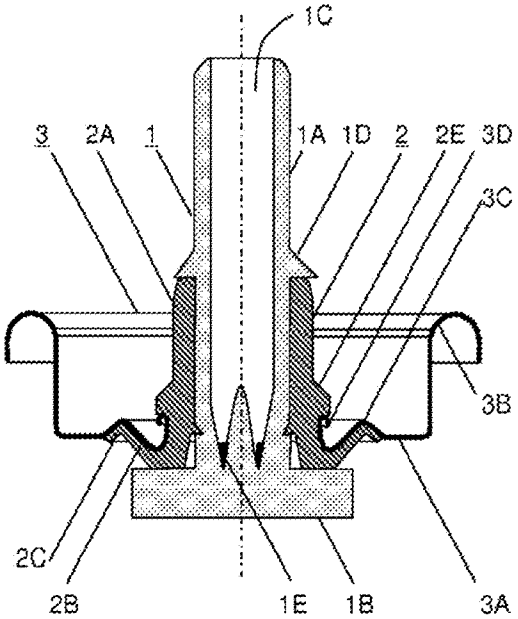
Fig. 1A Background Art
Figure 2:
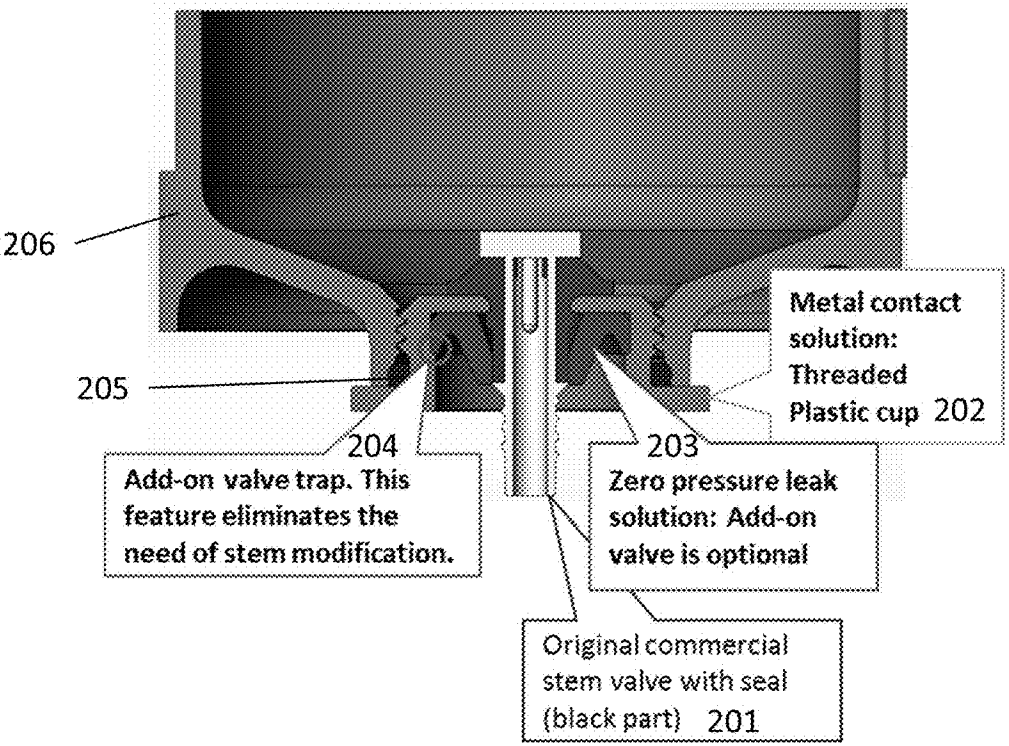
FIG. 2 shows a tilt valve system according to an embodiment.

FIG. 2 shows a tilt valve structure according to an embodiment. The structure includes a conventional stem valve with seal 201. The stem valve fits through an opening in a threaded plastic cup 202. An add on valve 203 is embedded within the plastic cup 202. Specifically, the plastic cup 202 includes an add on valve trap 204, which is a recess that supports an outer portion of the add on valve.

A crimped metal cup as used in the conventional art cannot be used with certain cosmetic creams due to its reactivity with peroxide in the cream. The present embodiment solution provides a plastic cup fully compatible with current valves. The plastic cup can be made of any number of plastic materials known in the art, such as the same material as used for a plastic container. As shown in FIG. 2, this plastic cup attaches directly onto the container 206 and sealed using an O-ring 205.

The add-on valve 203 reinforces the return force experience by the stem allowing it to seal itself even with low or zero pressure inside the container 206. This add-on valve can be used with currently manufactured standard valves. The add-on valve is disposed in the plastic cup, but the "spring" force is active on the stem itself—this gives the required preload to the stem, to ensure the sealing at zero pressure. Any number of materials may be used for the add-on valve which have elastic qualities and provide a "spring" return characteristic when bent. One such material is rubber. A non-limiting example of a material is "PU 70 shore A black".

The threaded plastic cup contains a small trap/indentation 204 allowing the zero-pressure add-on to be fixed to standard tilt-valves without modifying them.

FIGS. 3A-3E show detailed views of the threaded plastic cap. The dimensions shown in FIGS. 3A-3E are non-limiting examples and they may be adjusted as necessary.

Figure 3B:
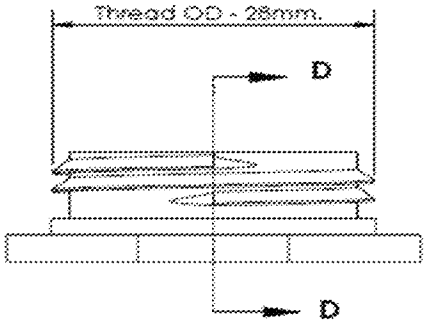
FIGS. 3A-3E show detailed views of the threaded plastic cap.
Figure 3C:
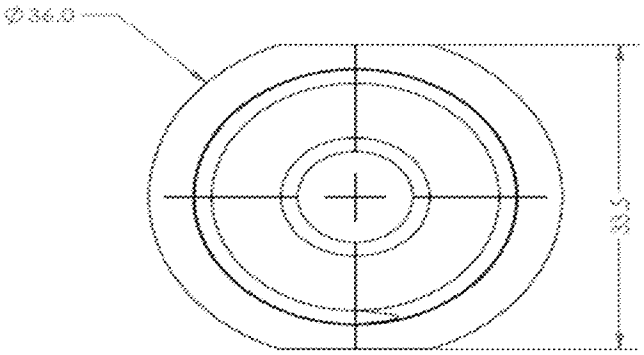
Figure 3D:
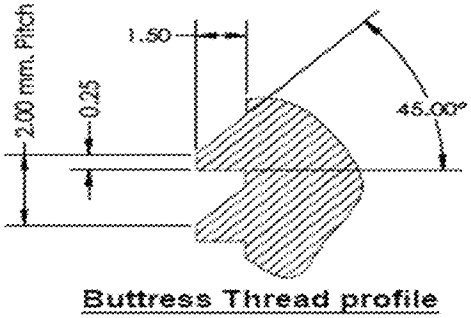
Figure 3A:
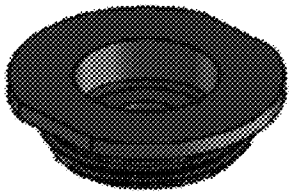

FIG. 3A shows a three-dimensional view of the plastic cap. FIG. 3B shows a profile view of the plastic cap. FIG. 3C shows an overhead view of the plastic cap. The plastic cap constitutes a threaded plastic insert, with interfaces for standard stem, standard gasket and customized add-on. The threading is configured to fit the container interface. FIG. 3D shows a buttress thread profile.

Figure 3E:
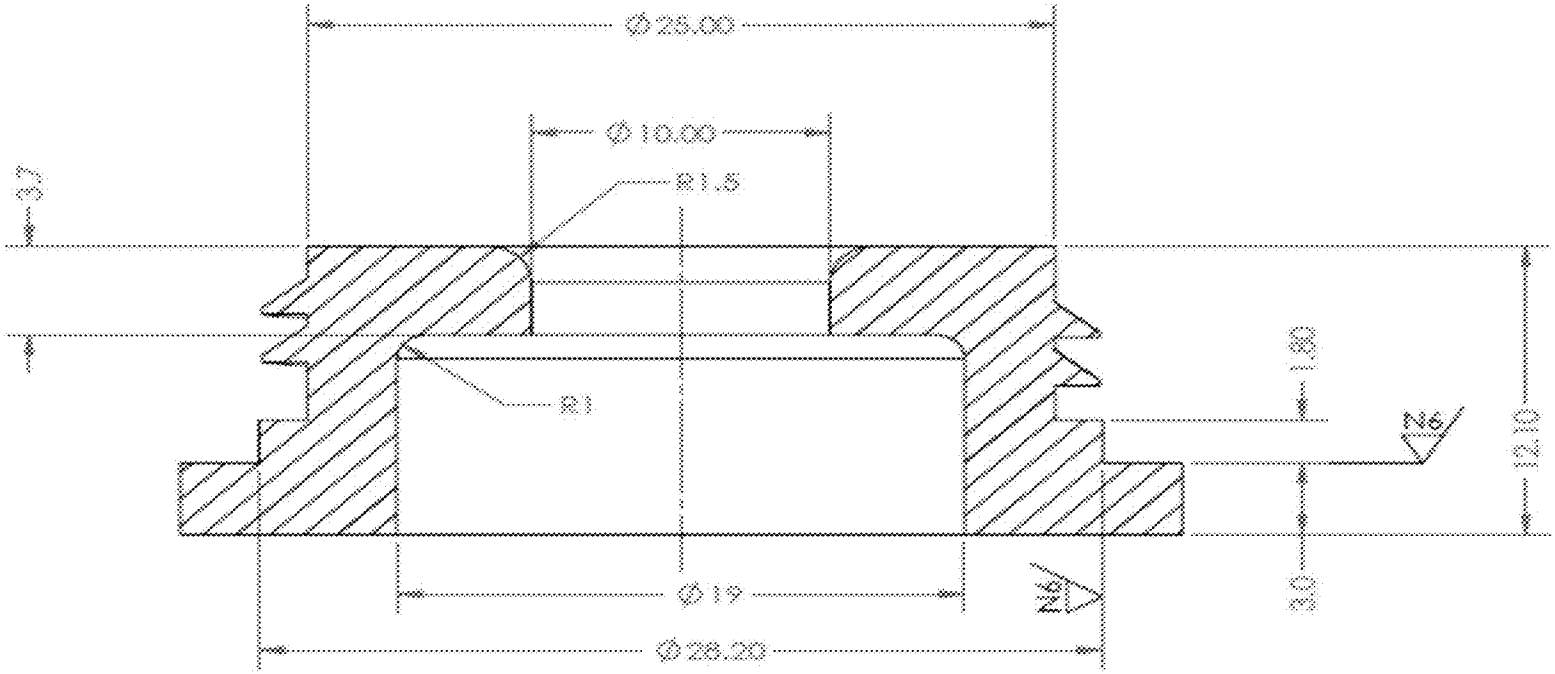

FIG. 3E shows a cross-section of the plastic cap (along the line D-D shown in FIG. 3B) and accompanying dimensions (in mm).

Figure 4C:
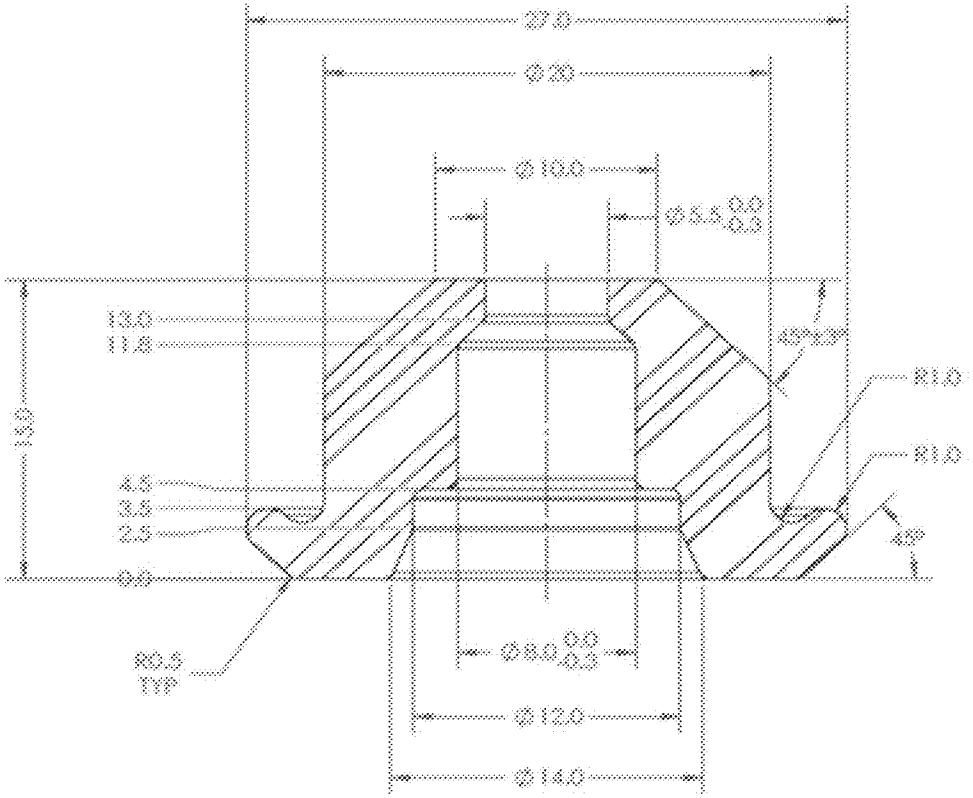
FIGS. 4A-4C show detailed views of the add-on valve.
Figure 4A:
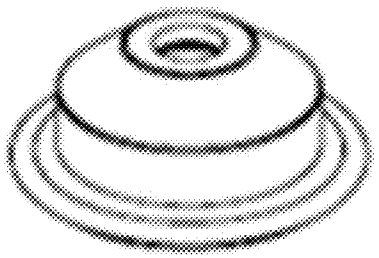
Figure 4B:
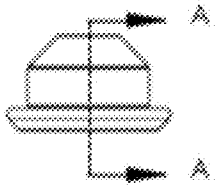

FIGS. 4A-4C show detailed views of the add-on valve. The dimensions shown in FIGS. 4A-4C are non-limiting examples and they may be adjusted as necessary. FIG. 4A shows a three-dimensional view of the add-on valve. FIG. 4B shows a profile view of the add-on valve. FIG. 4C shows a cross-section of the add-on valve (along the line A-A shown in FIG. 4B) and accompanying dimensions (in mm). In general, the external diameter is for snapping in the plastic cap insert. The internal diameter may be designed to give the desired preload to the stem.

The claimed invention is not limited to the specifically disclosed embodiments, and various modifications, combinations and replacements may be made without departing from the scope of the present invention.

What is claimed is:

1. A support device configured to be coupled to a dispensing container that includes a tilt valve stem for dispensing a cosmetic cream, comprising:

a cap made of a plastic material that includes an opening for receiving the tilt valve stem, the tilt valve stem having a hollow tubular stem attached to an elastic sealing grommet, and an outer surface configured to attach to the dispensing container, wherein the outer surface attaches to the dispensing container via threads; and a valve configured to be disposed between an inner surface of the cap and the elastic sealing grommet of the tilt valve stem, the valve being configured to abut the inner surface of the cap at an angle at a portion of the inner surface that is parallel to the hollow tubular stem, abut the elastic sealing grommet at an angle, and reinforce a return force experience by the stem.

2. The support device according to claim 1, wherein the valve is made of a rubber material.

3. The support device according to claim 1, wherein the cosmetic cream is provided within the dispensing container at zero pressure.

4. The support device according to claim 1, wherein the cosmetic cream includes a peroxide.

5. The support device according to claim 1, wherein the valve is configured to be disposed in a recess of the inner surface of the cap.

6. The support device according to claim 1, wherein the valve includes a bend such the valve abuts the inner surface of the cap at two positions which are perpendicular to each other.

* * * * *